US010930248B2

(12) United States Patent
Lin

(10) Patent No.: US 10,930,248 B2
(45) Date of Patent: Feb. 23, 2021

(54) DISPLAY METHOD AND DISPLAY SYSTEM FOR REDUCING A DOUBLE IMAGE EFFECT

(71) Applicants: BenQ Intelligent Technology (Shanghai) Co., Ltd, Shanghai (CN); BENQ CORPORATION, Taipei (TW)

(72) Inventor: Hsin-Nan Lin, Taipei (TW)

(73) Assignees: BenQ Intelligent Technology (Shanghai) Co., Ltd, Shanghai (CN); BENQ CORPORATION, Taipei (TW)

( * ) Notice: Subject to any disclaimer, the term of this patent is extended or adjusted under 35 U.S.C. 154(b) by 0 days.

(21) Appl. No.: 16/656,541

(22) Filed: Oct. 17, 2019

(65) Prior Publication Data

US 2020/0135149 A1 Apr. 30, 2020

(30) Foreign Application Priority Data

Oct. 29, 2018 (CN) ..... 201811268100.7

(51) Int. Cl.
*G09G 5/18* (2006.01)
*G09G 5/10* (2006.01)

(52) U.S. Cl.
CPC ..... *G09G 5/18* (2013.01); *G09G 5/10* (2013.01); *G09G 2310/0237* (2013.01); *G09G 2310/08* (2013.01)

(58) Field of Classification Search
CPC .... G09G 5/10; G09G 5/18; G09G 2340/0435; G09G 2310/0237; G09G 2340/0464
See application file for complete search history.

(56) References Cited

U.S. PATENT DOCUMENTS

2005/0141783 A1* 6/2005 Chen ..... G09G 5/006 382/286
2006/0176261 A1* 8/2006 Nitta ..... G09G 3/3406 345/94
2011/0205344 A1 8/2011 Lee
2012/0127212 A1 5/2012 Lin
2013/0009974 A1 1/2013 Nurmi
2014/0192040 A1 7/2014 Hung
2014/0266996 A1* 9/2014 Slavenburg ..... G09G 5/363 345/102
2016/0078846 A1* 3/2016 Liu ..... G09G 5/18 345/212

FOREIGN PATENT DOCUMENTS

CN 103971652 A 8/2014
CN 106297713 A 1/2017

* cited by examiner

*Primary Examiner* — Kevin M Nguyen
(74) *Attorney, Agent, or Firm* — Winston Hsu

(57) ABSTRACT

A display method includes changing a first transmission rate of a panel data clock signal to a second transmission rate, changing a first vertical synchronization period of a vertical synchronization signal to a second vertical synchronization period including a vertical pixel active synchronization interval and a blank interval according to at least the second transmission rate of the panel data clock signal, and merely enabling a backlight device during a time interval of any length within the blank interval. The second transmission rate is greater than the first transmission rate. The second vertical synchronization period is greater than the first vertical synchronization period.

14 Claims, 4 Drawing Sheets

DISPLAY METHOD AND DISPLAY SYSTEM FOR REDUCING A DOUBLE IMAGE EFFECT

BACKGROUND OF THE INVENTION

1. Field of the Invention

The present invention illustrates a display method and a display system for reducing a double image effect, and more particularly, a display method and a display system for reducing the double image effect by maximizing a length of a vertical synchronization period.

2. Description of the Prior Art

Liquid crystal display (LCD) devices and organic light emitting diode (OLED) devices have been widely used in our daily life because they take several advantages of thin appearance, low power consumption, and no radiation. For example, the LCD devices and OLED devices can be applied to multimedia players, mobile phones, personal digital assistants, computer monitors, or flat-screen TVs.

A conventional display device uses a pulse width modulation signal for driving a backlight source when images are displayed on a screen. The backlight source is enabled or disabled during a time interval greater than an image frame duration according to the pulse width modulation signal. In the conventional display device, a user easily feels an image flickering effect when the image is displayed, thereby reducing the visual quality. Also, when the image belongs to a high-speed dynamic image and is displayed by using the screen with a high refresh frequency, a motion blur effect easily occurs, leading to reduced image quality. Further, the user can see a transient effect of unstable pixels when the image is in the process of refreshing their pixel polarities during the time interval of the backlight source being enabled. Therefore, it is easy for the user to see an unpleasant image flickering effect or a double image effect. Moreover, even if the user does not notice the image flickering effect of the screen when a high-speed image flickering effect or a high-frequency image flickering effect occurs, the user may unconsciously feel tired or suffer from permanent vision damage after watching flickering images for a long time. In order to reduce a refreshing time length of the image visible by human eyes, some advanced LCD devices use a pulse type backlight technology for separating a time interval of enabling the backlight source from a time interval of refreshing the image. Theoretically, when the backlight source is enabled during a time interval of stabilized LCD pixels, the motion blur effect can be avoided.

In order to maintain an average backlight brightness of the display device and reduce the motion blur effect, a duty cycle of the pulse width modulation signal has to be optimized for driving the backlight source (i.e., such as 16%). However, the optimized pulse modulation signal may not be supported by the display device. For example, when a vertical synchronization signal of the display device only supports a duty cycle of a small blank interval (i.e., for example, 4%), the optimized interval of enabling the backlight source should be overlapped with a vertical pixel active synchronization interval of the vertical synchronization signal. Therefore, the motion blur effect is introduced in some regions of the image displayed on the screen, thereby by leading to the double image effect. As a result, the visual quality may be decreased.

SUMMARY OF THE INVENTION

In an embodiment of the present invention, a display method for reducing a double image effect is introduced. The display method comprises changing a first transmission rate of a panel data clock signal to a second transmission rate, changing a first vertical synchronization period of a vertical synchronization signal to a second vertical synchronization period comprising a vertical pixel active synchronization interval and a blank interval according to at least the second transmission rate of the panel data clock signal, and merely enabling a backlight device during a time interval of any length within the blank interval. The second transmission rate is greater than the first transmission rate. The second vertical synchronization period is greater than the first vertical synchronization period.

In another embodiment of the present invention, a display method for reducing a double image effect is disclosed. The display method comprises acquiring a vertical synchronization period of a vertical synchronization signal of a display panel, the vertical synchronization period including a vertical pixel active synchronization interval and a blank interval, and merely enabling a backlight device during a time interval of any length within the blank interval. The vertical pixel active synchronization interval and an interval for enabling the backlight device are non-overlapped. An occupation ratio of the blank interval to the vertical synchronization period is greater than 5%.

In another embodiment of the present invention, a display system is disclosed. The display system comprises a display panel, a gate driving circuit, a data driving circuit, a timing controller, a backlight device, and a processor. The display panel comprises a plurality of pixels configured to display an image. The gate driving circuit is coupled to the plurality of pixels. The data driving circuit is coupled to the plurality of pixels. The timing controller is coupled to the gate driving circuit and the data driving circuit and configured to control the gate driving circuit and the data driving circuit. The processor is coupled to the timing controller and the backlight device and configured to control the timing controller and the backlight device. After the processor receives an image data signal, a panel data clock signal is generated. The processor changes a first transmission rate of the panel data clock signal to a second transmission rate, and changes a first vertical synchronization period of a vertical synchronization signal to a second vertical synchronization period according to at least the second transmission rate of the panel data clock signal. The second vertical synchronization period comprises a vertical pixel active synchronization interval and a blank interval. The timing controller controls the gate driving circuit and the data driving circuit for generating the image by driving the plurality of pixels during the vertical pixel active synchronization interval. The processor merely enables the backlight device during a time interval of any length within the blank interval. The second transmission rate is greater than the first transmission rate. The second vertical synchronization period is greater than the first vertical synchronization period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
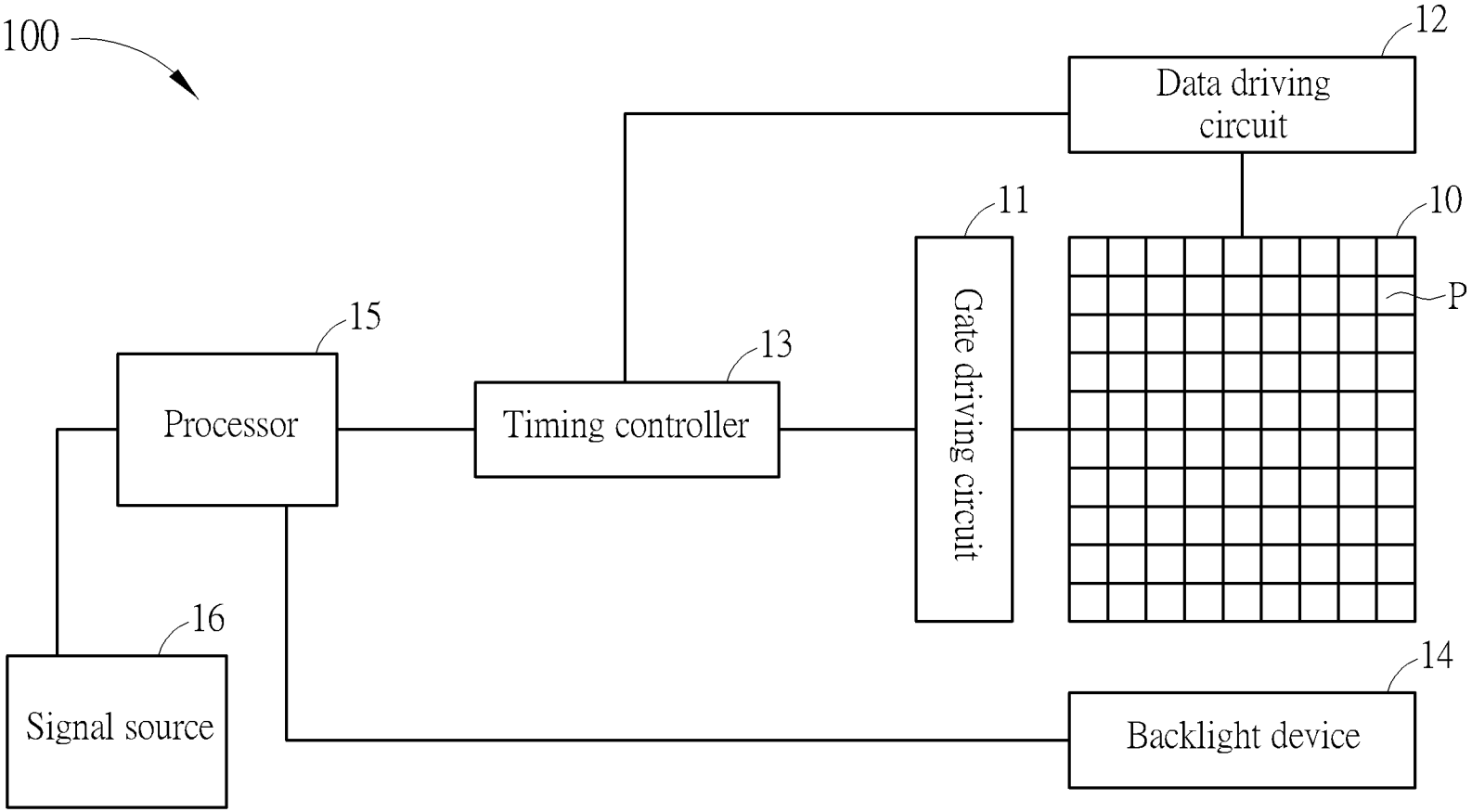
FIG. 1 is a block diagram of a display system according to an embodiment of the present invention.

FIG. 1 is a block diagram of a display system 100 according to an embodiment of the present invention. The display system 100 includes a display panel 10, a gate driving circuit 11, a data driving circuit 12, a timing controller 13, a backlight device 14, and a processor 15. The display panel 10 can be any panel type of display panels, such as a liquid crystal display (LCD) panel or an organic light emitting diode display panel. The display panel 10 includes a plurality of pixels P for displaying an image. The plurality of pixels P can form a pixel array to display the image with a rectangular shape. The gate driving circuit 11 is coupled to the plurality of pixels P for controlling the plurality of pixels P by using gate voltages. The gate voltages can control the plurality of pixels P by using a row by row scanning process for enabling or disabling the pixels P. The data driving circuit 12 is coupled to the plurality of pixels P for inputting data signals to the plurality of pixels P by using a column by column scanning process. After the plurality of pixels P receives the data signals, the plurality of pixels P can display various color tones and various gray levels. The timing controller 13 is coupled to the gate driving circuit 11 and the data driving circuit 12 for controlling the gate driving circuit 11 and the data driving circuit 12. The timing controller 13 can be a T-CON board. The T-CON board can be regarded as a core control circuit of the display panel 10 for controlling the gate driving circuit 11 and the data driving circuit 12 in order to scan the plurality of pixels P. The timing controller 13 can be used for converting a video input signal format (i.e., a Low Voltage Differential Signaling format, LVDS format) to a driving signal format (i.e., a Reduced Swing Differential Signal format, RSDS format). The backlight device 14 can be used for providing a backlight signal. The backlight device 14 can be any illumination controllable device. For example, the backlight device 14 can be a light-emitting diode array, an incandescent light bulb, an electroluminescent panel (ELP), or a cold cathode fluorescent lamp (CCFL). The processor 15 is coupled to the timing controller 13 and the backlight device 14 for controlling the timing controller 13 and the backlight device 14. The processor 15 can be any type of logical computing elements. For example, the processor 15 can be a processing chip (Scaler) inside the display system 100. The processor 15 can be a microprocessor. Further, a plurality of sets of timing parameters can also be stored in the processor 15. The processor 15 can communicate with the timing controller 13 through an inter-integrated circuit ($I^2C$). Further, the processor 15 can receive an image data signal generated by a signal source 16. The image data signal generated by the signal source 16 can be a video data stream generated by a graphics card of the computer, or a video data stream generated by a video player (i.e., such as a DVD player). Any reasonable hardware modification falls into the scope of the present invention.

In the display system 100, after the processor 15 receives the image data signal, a panel data clock signal can be generated. The processor 15 can change a first transmission rate of the panel data clock signal to a second transmission rate. Then, the processor 15 can change a first vertical synchronization period of a vertical synchronization signal to a second vertical synchronization period according to at least the second transmission rate of the panel data clock signal. The second vertical synchronization period includes a vertical pixel active synchronization interval and a blank interval. The timing controller 13 can control the gate driving circuit 11 and the data driving circuit 12 for generating the image by driving the plurality of pixels P during the vertical pixel active synchronization interval. In order to avoid the double image effect, the processor 15 merely enables the backlight device 14 during a time interval of any length within the blank interval. Here, the double image effect can be categorized as an image sticking effect caused by the motion blur. The second transmission rate is greater than the first transmission rate. The second vertical synchronization period is greater than the first vertical synchronization period. Details of the display method for reducing the double image effect performed by the display system 100 are illustrated below.

Figure 2:
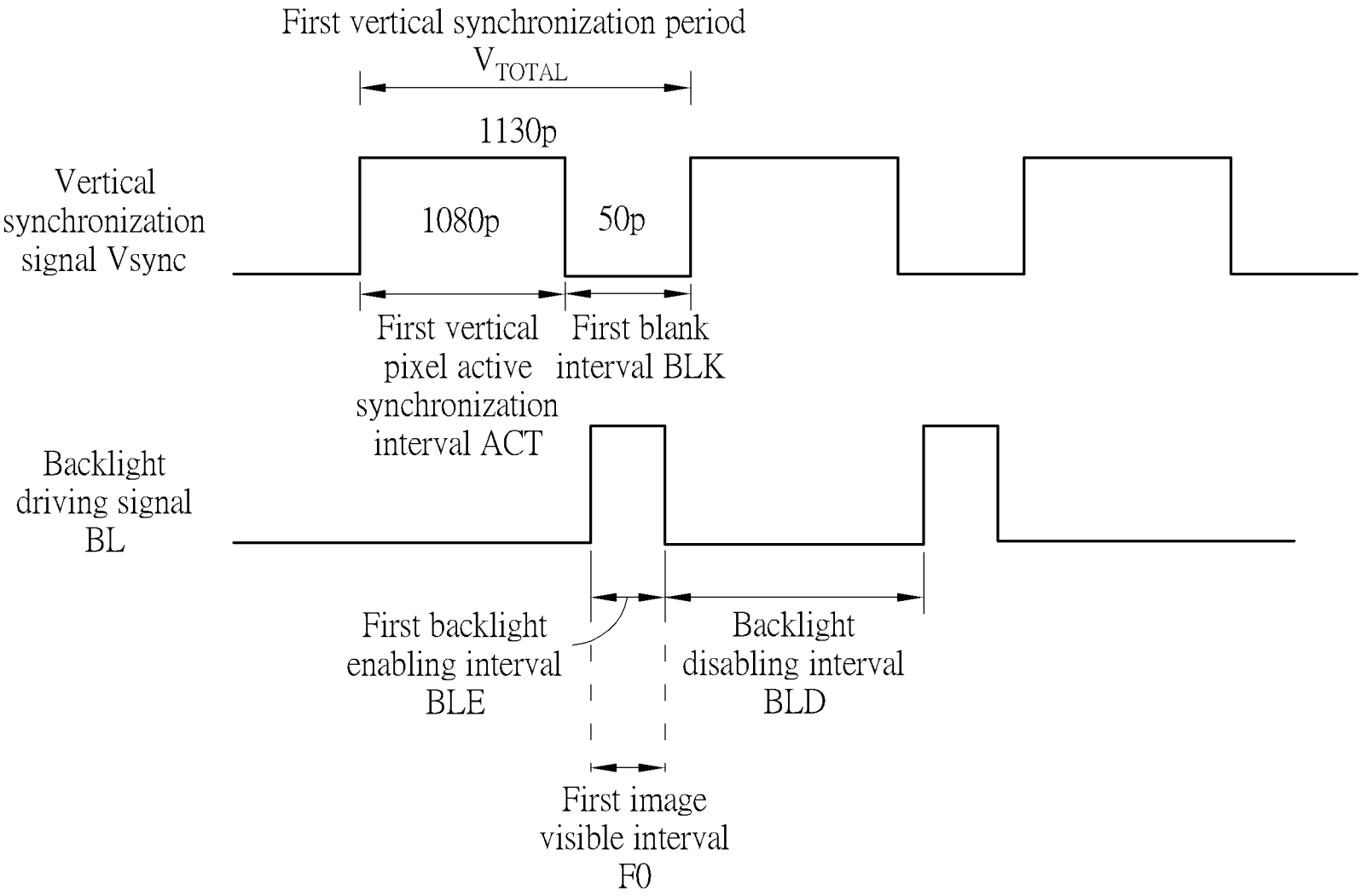
FIG. 2 illustrates signal waveforms of a vertical synchronization signal and a backlight driving signal under initial configurations for the display system in FIG. 1.

FIG. 2 illustrates signal waveforms of the vertical synchronization signal Vsync and the backlight driving signal BL under initial configurations for the display system 100. In FIG. 2, for simplicity, an amount of vertical pixels of the display panel 10 is set to 1080. The vertical synchronization signal Vsync can be a periodic signal. In FIG. 2, a period of the vertical synchronization signal Vsync is equal to a time length for scanning 1130 pixels. Therefore, in FIG. 2, a first vertical synchronization period VTOTAL can be defined as the time length for scanning the 1130 pixels, denoted as 1130p. The first vertical synchronization period VTOTAL includes a first vertical pixel active synchronization interval ACT and a first blank interval BLK. The first vertical pixel active synchronization interval ACT corresponds to an amount of vertical pixels of the display panel 10. Therefore, a time length of the first vertical pixel active synchronization interval ACT can be defined as a time length for scanning the 1080 pixels, denoted as 1080p. Further, a time length of the first blank interval BLK can be derived by subtracting the time length of the first vertical pixel active synchronization interval ACT from the first vertical synchronization period VTOTAL. Therefore, the time length of the first blank interval BLK can be defined as a time length for scanning the 1130-1080 pixels, denoted as 50p. Here, since the amount of vertical pixels of the display panel 10 is equal to 1080, the first vertical synchronization period VTOTAL (i.e., the time length for scanning 1130 pixels) includes the time length for scanning 1080 real vertical pixels during the first vertical pixel active synchronization interval ACT, and the time length for scanning 50 virtual pixels during the first blank interval BLK. In other words, the pixels P of the display panel 10 are enabled under a transient state (i.e., a state of refreshing pixels) during the first vertical pixel active synchronization interval ACT. The pixels P of the display panel 10 are enabled under a steady state during the first blank interval BLK. When the pixels P are enabled under the transient state, liquid crystal molecules of the pixels P are rotating and unstable. When the pixels P are enabled under the steady state, the liquid crystal molecules of the pixels P are stable. For avoiding the double image effect caused by the motion blur, the backlight driving signal BL can merely enable the backlight device 14 during a first backlight enabling interval BLE within the first blank interval BLK. Further, the backlight driving signal BL can disable the backlight device 14 during a backlight disabling interval BLD. Therefore, for a viewer, the pixels P of a displayed image during a first image visible interval F0 are enabled under the steady state. Therefore, no double image effect is introduced, leading to visual experience improvement.

Figure 3:
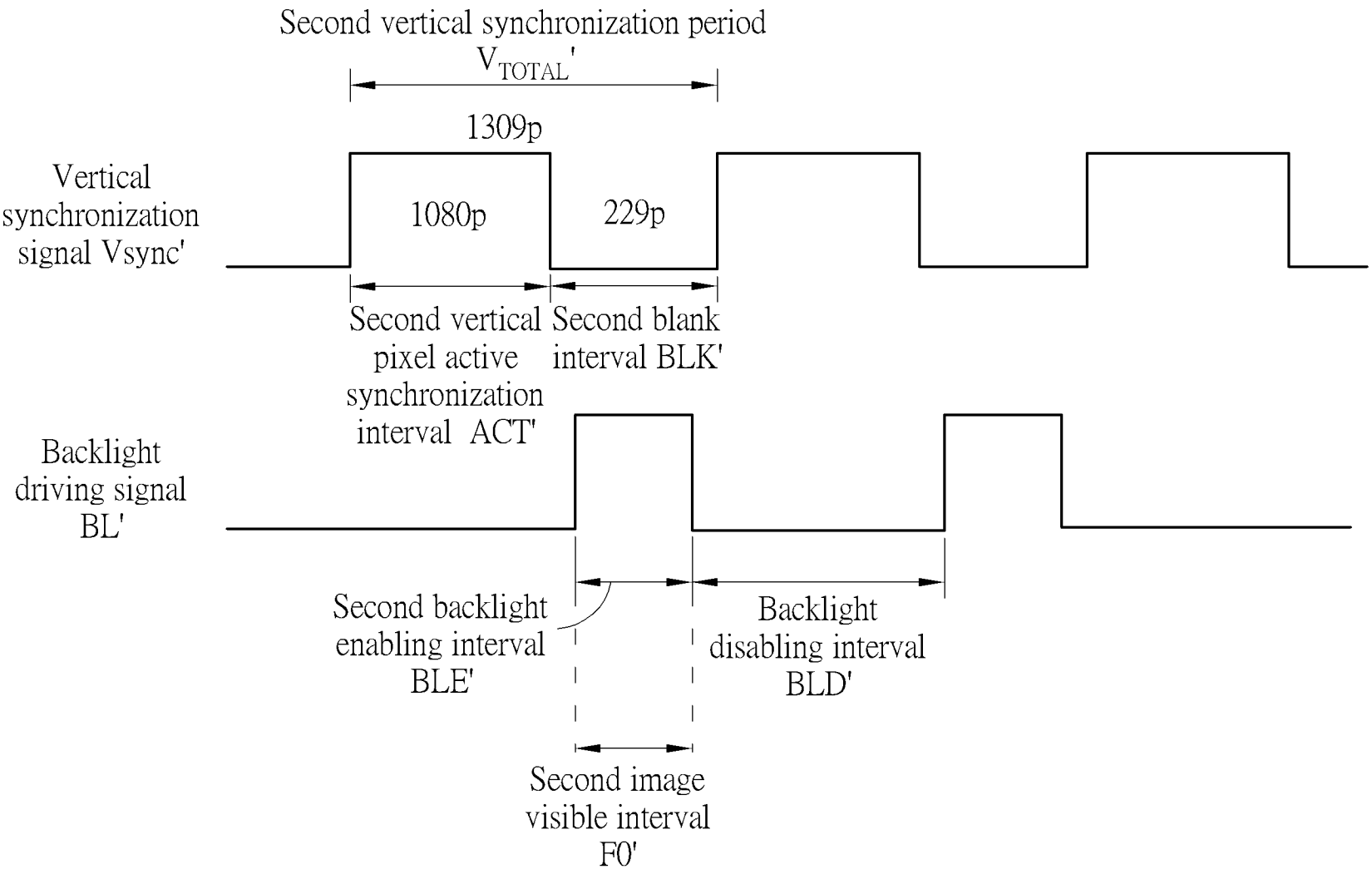
FIG. 3 illustrates signal waveforms of the vertical synchronization signal and the backlight driving signal under updated configurations for the display system in FIG. 1.

Unfortunately, in FIG. 2, since the time length of the first blank interval BLK is equal to the time length for scanning 50 pixels, it implies that the vertical synchronization signal Vsync only supports a small duty cycle of the first blank interval BLK, equal to 50/1130=4.4%. In other words, unless a duty cycle of the backlight driving signal BL is smaller than 4.4%, the display system 100 cannot provide a double image effect cancellation function. Further, even if the duty cycle of the backlight driving signal BL is smaller than 4.4%, since the backlight driving signal BL is a pulse width modulation (PWM) signal, a small duty cycle results in an energy reduction of the PWM signal. Therefore, the brightness of the displayed image is insufficient. In order to solve this problem, the display system 100 can adjust the first blank interval BLK to the second blank interval BLK' (i.e., as shown in FIG. 3) for optimizing the backlight driving signal BL. The second blank interval BLK' is longer than the first blank interval BLK. By doing so, the display system 100 is capable of reducing the double image effect and providing the sufficient brightness of the displayed image, as illustrated below.

FIG. 3 illustrates signal waveforms of the vertical synchronization signal Vsync' and the backlight driving signal BL' under updated configurations for the display system 100. Here, in the display system 100, a transmission rate of the panel data clock signal, a horizontal synchronization period of a horizontal synchronization signal, and a vertical synchronization period of the vertical synchronization signal satisfy an equation:

$$P_{DATA}=H_{TOTAL}\times V_{TOTAL}\times FR$$

$P_{DATA}$ is the transmission rate. $H_{TOTAL}$ is the horizontal synchronization period. $V_{TOTAL}$ is the vertical synchronization period. FR is a frame rate constant. Thus, in the aforementioned embodiment, the first vertical synchronization period $V_{TOTAL}$ is set to the time length for scanning 1130 pixels. When the first horizontal synchronization period $H_{TOTAL}$ is set to the time length for scanning 525 pixels and the frame rate constant FR is set to 144 Hz (Hertz), the transmission rate $P_{DATA}$ of the panel data clock signal of the display system 100 is equal to 525×1130×144 (pixel-per-second). In order to increase the first vertical synchronization period $V_{TOTAL}$, the transmission rate $P_{DATA}$ of the panel data clock signal can be increased according to the equation previously illustrated. Also, the transmission rate $P_{DATA}$ of the panel data clock signal can be increased while the horizontal synchronization period $H_{TOTAL}$ is decreased. For example, a first transmission rate (i.e., 75 MHz) of the panel data clock signal can be changed to a second transmission rate (i.e., 99 MHz). Further, the processor 15 can change a first horizontal synchronization period (i.e., a time length for scanning 560 pixels) of the horizontal synchronization signal to a second horizontal synchronization period (i.e., a time length for scanning 525 pixels). Here, the second horizontal synchronization period is smaller than the first horizontal synchronization period. When the frame rate constant FR is set to 144 Hz, the first vertical synchronization period $V_{TOTAL}$ can be updated as:

$$V_{TOTAL}=P_{DATA}/(H_{TOTAL}\times FR)=99000000/(525\times 144)=1309.52$$

Therefore, when the transmission rate $P_{DATA}$ of the panel data clock signal is increased while the horizontal synchronization period $H_{TOTAL}$ is decreased, the first vertical synchronization period $V_{TOTAL}$ can be updated substantially equal to a time length for scanning 1309 pixels. However, for avoiding ambiguity, in FIG. 3, the vertical synchronization period for scanning 1309 pixels is called as "a second vertical synchronization period $V_{TOTAL}$'". The vertical synchronization signal in FIG. 3 is called as "a vertical synchronization signal Vsync'". The backlight driving signal in FIG. 3 is called as "a backlight driving signal BL'". In other words, the second vertical synchronization period $V_{TOTAL}$' can be defined as the time length for scanning the 1309 pixels, denoted as 1309p. The second vertical synchronization period $V_{TOTAL}$' includes a second vertical pixel active synchronization interval ACT' and a second blank interval BLK'. The second vertical pixel active synchronization interval ACT' corresponds to the amount of vertical pixels of the display panel 10. Therefore, the time length of the first vertical pixel active synchronization interval ACT and the time length of the second vertical pixel active synchronization interval ACT' are identical, denoted as 1080p. Since the vertical pixel active synchronization interval is a constant (i.e., ACT=ACT'), when the first vertical synchronization period $V_{TOTAL}$ (1130p) of the vertical synchronization signal Vsync is changed to the second vertical synchronization period $V_{TOTAL}$' (1309p), a time length of the first blank interval BLK is changed from a first time length (50p) to a second time length (229p). In other words, a time length of a second blank interval BLK' can be derived by subtracting the time length of the second vertical pixel active synchronization interval ACT' from the second vertical synchronization period $V_{TOTAL}$'. In other words, the time length of the second blank interval BLK' can be defined as the time length for scanning the 1309-1080 pixels, denoted as 229p. Similarly, for avoiding the double image effect caused by the motion blur, the backlight driving signal BL' can merely enable the backlight device 14 during a second backlight enabling interval BLE' within the second blank interval BLK'. Further, the backlight driving signal BL' can disable the backlight device 14 during a backlight disabling interval BLD'. Since the processor 15 disables the backlight device 14 outside the second blank interval BLK', the second vertical pixel active synchronization interval ACT' and an interval for enabling the backlight device 14 are non-overlapped. Therefore, for a viewer, the pixels P of a displayed image during a second image visible interval F0 are enabled under the steady state. Therefore, no double image effect is introduced, leading to visual experience improvement.

Comparing FIG. 3 with FIG. 2, in the display system 100, since the second vertical synchronization period $V_{TOTAL}$' is greater than the first vertical synchronization period $V_{TOTAL}$, the time length of the second blank interval BLK' is greater than the time length of the first blank interval BLK. In other words, after the first vertical synchronization period $V_{TOTAL}$ is changed to the second vertical synchronization period $V_{TOTAL}$', a duty cycle (4.4%) of the first blank interval BLK supported by the first vertical synchronization signal Vsync can be increased to a duty cycle (229/1309=17.4%) of the second blank interval BLK' supported by the second vertical synchronization signal Vsync'. An increment is about 13%. As previously mentioned, in order to design the display system 100 capable of reducing the double image effect and providing the sufficient brightness of the displayed image, a duty cycle of the backlight driving signal has to be optimized for driving the backlight device 14. For example, when the duty cycle of the backlight driving signal BL' is optimized equal to 16%, since the duty cycle of the second blank interval BLK' supported by the second vertical synchronization signal Vsync' is greater than 16%, the display system 100 can support the optimal duty cycle of the backlight driving signal BL'. In other words, since the second time length (229p) of the second blank interval BLK' is greater than the first time length (50p) of the first blank interval BLK, the display system 100 can provide high flexibility for optimizing the backlight driving signal BL'. In other embodiments, the second vertical synchronization period $V_{TOTAL}'$ can approach a maximum vertical synchronization period supported by the display panel 10. By doing so, the display system 100 is capable of reducing the double image effect and providing the sufficient brightness of the displayed image.

However, the present invention is not limited to setting the duty cycle of the second blank interval BLK' supported by the second vertical synchronization signal Vsync' greater than the optimal duty cycle of the backlight driving signal BL' by using the aforementioned method. For example, a user can directly select the second vertical synchronization period $V_{TOTAL}'$ greater than the first vertical synchronization period $V_{TOTAL}$ from a plurality of vertical synchronization periods supported by the display panel 10 through the processor 15. The user can directly select a display panel supporting the large second vertical synchronization period $V_{TOTAL}'$. When the second blank interval BLK' is sufficiently large, the backlight driving signal BL' supported by the display system 100 can be optimized. Further, the first transmission rate of the panel data clock signal can be changed to the second transmission rate for maximizing the second vertical synchronization period $V_{TOTAL}'$. As previously mentioned, when the double image effect is completely removed, the second vertical pixel active synchronization interval ACT' and the interval (i.e., the second backlight enabling interval BLE') for enabling the backlight device 14 are non-overlapped in the display panel 10 supporting the large second vertical synchronization period $V_{TOTAL}'$. Further, the display system 100 can use a "sub-optimal" pulse width modulation signal for driving the backlight device 14. For example, the display system 100 can use a pulse width modulation signal with a duty cycle equal to 5% for driving the backlight device 14. An occupation ratio of the second blank interval BLK' to the second vertical synchronization period $V_{TOTAL}'$ of the display system 100 is greater than 5%. Based on this design, although the brightness of the image displayed on the display panel 10 is slightly reduced, the display system 100 can completely eliminate the double image effect caused by the motion blur.

As previously mentioned, in the display system 100, the processor 15 can receive the image data signal generated by the signal source 16. The image data signal generated by the signal source 16 can be the video data stream generated by the graphics card of the computer, or the video data stream generated by the video player. For example, the graphics card of the computer can generate a video data stream with transmission rate equal to 144M (pixel-per-second). Then, the processor 15 can generate a plurality of panel data clock signal options with different transmission rates for the user. For example, when the user wants to increase the second vertical synchronization period $V_{TOTAL}'$ to reach the maximum vertical synchronization period supported by the display system 100, the user can select an appropriate transmission rate $P_{DATA}$ of the panel data clock signal for displaying images. As previously mentioned, the selected transmission rate $P_{DATA}$ can be greater than a default transmission rate of the display panel 10. The transmission rate of the image data signal received by the processor 15 can be different from the transmission rate of the panel data clock signal. In other words, the processor 15 is capable of modulating signals. Therefore, the processor 15 can optimally generate the panel data clock signal with the transmission rate $P_{DATA}$ used for the display panel 10.

Figure 4:
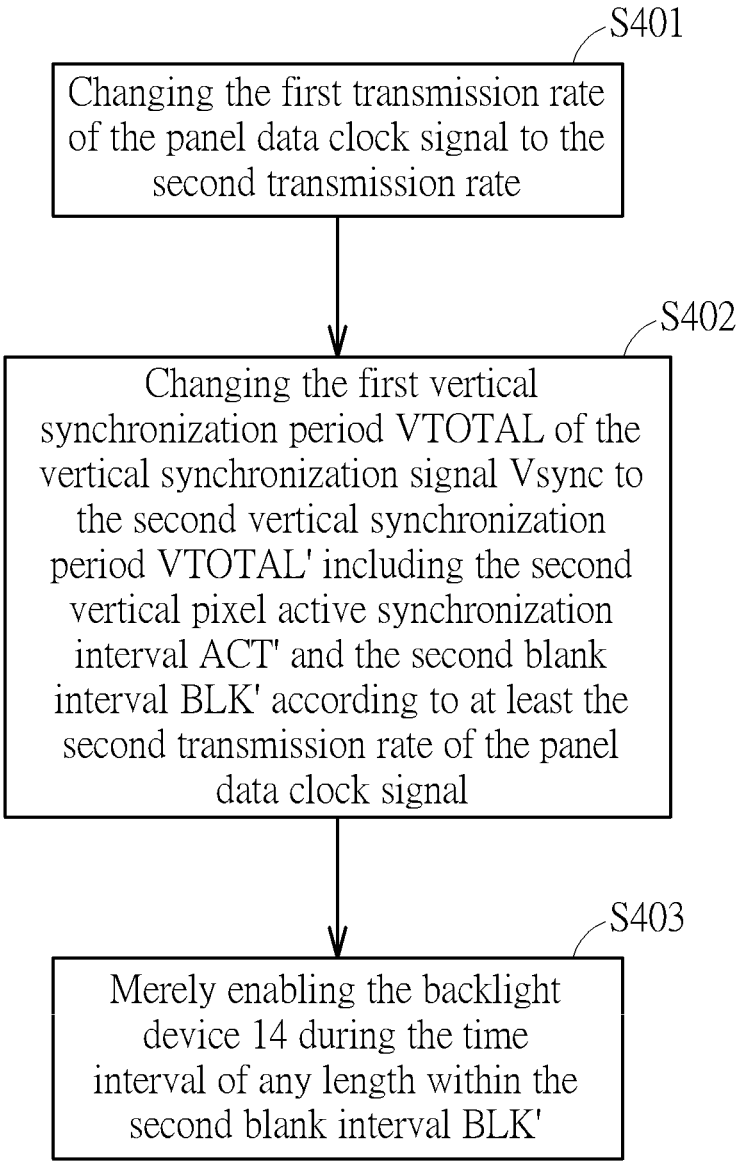
FIG. 4 is a flow chart of a display method performed by the display system in FIG. 1.

FIG. 4 is a flow chart of a display method performed by the display system 100. The display method performed by the display system 100 can include step S401 to step S403. Any reasonable technology modification falls into the scope of the present invention. Step S401 to step S403 are illustrated below.

step S401: changing the first transmission rate of the panel data clock signal to the second transmission rate;

step S402: changing the first vertical synchronization period $V_{TOTAL}$ of the vertical synchronization signal Vsync to the second vertical synchronization period $V_{TOTAL}'$ including the second vertical pixel active synchronization interval ACT' and the second blank interval BLK' according to at least the second transmission rate of the panel data clock signal;

step S403: merely enabling the backlight device 14 during the time interval of any length within the second blank interval BLK'.

Details of step S401 to step S403 are previously illustrated. Thus, they are omitted here. In the display system 100, when the second vertical synchronization period $V_{TOTAL}'$ is large enough, the backlight device 14 can be operated by using an optimal backlight driving signal with a high duty cycle supported by the second blank interval BLK'. In other words, the backlight enabling interval and the backlight disabling interval of the backlight device 14 can be optimized for avoiding the double image effect caused by the motion blur. Therefore, the visual experience can be improved.

To sum up, the present invention discloses a display method and a display system for reducing a double image effect. The display system can maximize a vertical synchronization period by increasing a transmission rate of a panel data clock signal and/or decreasing a horizontal synchronization period. The user can directly select an option of a large vertical synchronization period supported by the display panel. By doing so, since a time length of the vertical synchronization period is large, a time length of the blank interval within the vertical synchronization period is also large. When the time length of the blank interval is large enough, it implies that the time length of the blank interval is greater than a duty cycle of an optimal backlight driving signal. Therefore, the backlight device can be used for reducing or eliminating the double image effect according to the optimal backlight driving signal and an adjusted vertical synchronization signal. In other words, since the time length of the blank interval is large enough, the display system can perform a pulse type backlight driving mode by using the optimal backlight driving signal for enabling the backlight device within the blank interval. Therefore, for a viewer, pixels of the displayed image are already refreshed and are enabled under the steady state during an image visible interval. Therefore, since the display system can avoid the double image effect and provide the sufficient brightness of the displayed image, the visual experience can be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display method for reducing a double image effect comprising:

selecting a second vertical synchronization period supported by a display panel greater than a first vertical synchronization period for increasing a first transmission rate of a panel data clock signal to a second transmission rate;

increasing a blank interval of the second vertical synchronization period according to the second transmission rate of the panel data clock signal, wherein the second vertical synchronization period comprises a vertical pixel active synchronization interval and the blank interval; and merely enabling a backlight device during a time interval of any length within the blank interval;

wherein the second transmission rate;

wherein the panel data clock signal is generated after an image data signal is received by a processor, the panel data clock signal has the first transmission rate equal to $H_{TOTAL} \times V_{TOTAL} \times FR$, $H_{TOTAL}$ is a horizontal synchronization period of a horizontal synchronization signal, $V_{TOTAL}$ is the first vertical synchronization period, and FR is a frame rate constant; and wherein after the second transmission rate is selected, the second transmission rate is equal to $H_{TOTAL} \times V_{TOTAL}' \times FR$, and $V_{TOTAL}'$ is the second vertical synchronization period.

2. The method of claim 1, further comprising:

changing a first horizontal synchronization period of the horizontal synchronization signal to a second horizontal synchronization period;

wherein the second horizontal synchronization period is smaller than the first horizontal synchronization period.

3. The method of claim 1, wherein the vertical pixel active synchronization interval is a constant, when the first vertical synchronization period of the vertical synchronization signal is changed to the second vertical synchronization period, a time length of the blank interval is changed from a first time length to a second time length, and the second time length is greater than the first time length.

4. The method of claim 1, wherein the second vertical synchronization period approaches a maximum vertical synchronization period supported by the display panel.

5. The method of claim 1, further comprising:

disabling the backlight device outside the blank interval;

wherein the vertical pixel active synchronization interval and an interval for enabling the backlight device are non-overlapped.

6. The method of claim 1, further comprising:

receiving the image data signal generated by a signal source; and generating the panel data clock signal according to the image data signal;

wherein a transmission rate of the image data signal is different from the second transmission rate of the panel data clock signal.

7. The method of claim 1, wherein the backlight device is driven by using a backlight pulse width modulation signal, and after the first vertical synchronization period of the vertical synchronization signal is changed to the second vertical synchronization period, a duty cycle of the backlight pulse width modulation signal is smaller than a duty cycle of the vertical synchronization signal.

8. A display system comprising:

a display panel comprising a plurality of pixels configured to display an image;

a gate driving circuit coupled to the plurality of pixels;

a data driving circuit coupled to the plurality of pixels;

a timing controller coupled to the gate driving circuit and the data driving circuit and configured to control the gate driving circuit and the data driving circuit;

a backlight device; and a processor coupled to the timing controller and the backlight device and configured to control the timing controller and the backlight device;

wherein after the processor receives an image data signal, a panel data clock signal is generated, the display panel is selected for supporting a second vertical synchronization period greater than a first vertical synchronization period for increasing a first transmission rate of the panel data clock signal to a second transmission rate, the processor increases a blank interval of the second vertical synchronization period according to the second transmission rate of the panel data clock signal, the second vertical synchronization period comprises a vertical pixel active synchronization interval and the blank interval, and the timing controller controls the gate driving circuit and the data driving circuit for generating the image by driving the plurality of pixels during the vertical pixel active synchronization interval; and wherein the processor merely enables the backlight device during a time interval of any length within the blank interval, the second transmission rate is greater than the first transmission rate, and the second vertical synchronization period is greater than the first vertical synchronization period;

wherein the panel data clock signal has the first transmission rate equal to $H_{TOTAL} \times V_{TOTAL} \times FR$, $H_{TOTAL}$ is a horizontal synchronization period of a horizontal synchronization signal, $V_{TOTAL}$ is the first vertical synchronization period, and FR is a frame rate constant; and wherein after the second transmission rate is selected, the second transmission rate is equal to $H_{TOTAL} \times V_{TOTAL} \times$ 'FR, and $V_{TOTAL}'$ is the second vertical synchronization period.

9. The system of claim 8, wherein the processor changes a first horizontal synchronization period of the horizontal synchronization signal to a second horizontal synchronization period, and the second horizontal synchronization period is smaller than the first horizontal synchronization period.

10. The system of claim 8, wherein the vertical pixel active synchronization interval is a constant, when the first vertical synchronization period of the vertical synchronization signal is changed to the second vertical synchronization period, a time length of the blank interval is changed from a first time length to a second time length, and the second time length is greater than the first time length.

11. The system of claim 8, wherein the second vertical synchronization period approaches a maximum vertical synchronization period supported by the display panel.

12. The system of claim 8, wherein the processor disables the backlight device outside the blank interval, and the vertical pixel active synchronization interval and an interval for enabling the backlight device are non-overlapped.

13. The system of claim 8, wherein a transmission rate of the image data signal received by the processor is different from the second transmission rate of the panel data clock signal.

14. The system of claim 8, wherein the backlight device is driven by using a backlight pulse width modulation signal, and after the first vertical synchronization period of the vertical synchronization signal is changed to the second vertical synchronization period, a duty cycle of the backlight pulse width modulation signal is smaller than a duty cycle of the vertical synchronization signal.

* * * * *